US007824241B2

(12) United States Patent
Duprey

(10) Patent No.: US 7,824,241 B2
(45) Date of Patent: Nov. 2, 2010

(54) NOVELTY SPY KIT

(76) Inventor: Michael A. Duprey, 5700 Southampton Rd., Charlotte, NC (US) 28217

( * ) Notice: Subject to any disclaimer, the term of this patent is extended or adjusted under 35 U.S.C. 154(b) by 341 days.

(21) Appl. No.: 11/907,620

(22) Filed: Oct. 15, 2007

(65) Prior Publication Data

US 2009/0098800 A1 Apr. 16, 2009

(51) Int. Cl.
*A63H 33/00* (2006.01)

(52) U.S. Cl. ..... 446/26; 446/219

(58) Field of Classification Search ..... 446/26, 446/219, 140, 227, 449
See application file for complete search history.

(56) References Cited

U.S. PATENT DOCUMENTS

| | | | | |
|---|---|---|---|---|
| 3,786,237 | A * | 1/1974 | Postal | 235/491 |
| 4,060,929 | A * | 12/1977 | Meyer et al. | 446/219 |
| 4,249,072 | A * | 2/1981 | Buros | 235/491 |
| 4,604,065 | A * | 8/1986 | Frazer et al. | 434/331 |
| 5,850,753 | A * | 12/1998 | Varma | 70/278.7 |
| 6,644,557 | B1 * | 11/2003 | Jacobs | 236/46 R |
| 6,877,097 | B2 * | 4/2005 | Hamid et al. | 713/186 |
| 7,198,382 | B2 * | 4/2007 | Donovan | 362/184 |
| 2002/0032976 | A1 * | 3/2002 | Riener | 42/70.11 |
| 2007/0013865 | A1 * | 1/2007 | Jordan | 351/158 |
| 2007/0030442 | A1 * | 2/2007 | Howell et al. | 351/158 |
| 2007/0127250 | A1 * | 6/2007 | Waters | 362/419 |

* cited by examiner

*Primary Examiner*—Nini Legesse
(74) *Attorney, Agent, or Firm*—Leslie A. Thompson & Associates; Leslie A. Thompson

(57) ABSTRACT

A novelty spy kit for the enjoyment of children and adults that includes an electronic spy safe, a mobile fingerprint analyzer, and a covert messaging system. The safe is bifurcated with a first section that features a central processing unit and a pivoting door panel that provides the user access to a simulated palm scanner which facilitates access to the storage area of the second section. A mobile fingerprint analyzer embodied as a wristwatch with a face that displays a working digital clock and is pivotally attached to expose a secret compartment used for analyzing fingerprint samples. The covert messaging system teaches a pair of eyeglasses having red LEDs incorporated therein and stationery that bears alphanumeric indicia randomly arranged thereon. Using a special pen, the user can secretly transcribe a message that can only be viewed under the illumination of the red LEDs projected from the eyeglasses.

15 Claims, 8 Drawing Sheets

NOVELTY SPY KIT

1. REFERENCE TO RELATED APPLICATION

This application claims priority to no previously filed applications.

2. FIELD OF THE INVENTION

The invention relates to a novelty spy kit, more specifically, the kit includes, but is not limited to, a plurality of stealth means for conveying, retaining, and analyzing various types of information.

BACKGROUND OF THE INVENTION

The present invention includes a plurality of components that form a novelty spy kit, which provides means and methods for facilitating the execution of certain tasks in a "cloak and dagger" manner that provides amusement and intrigue for children and adults alike. The novelty spy kit allows the user to engage in covert activities using the stealth typically associated with the world of espionage, thus lending itself to countless scenarios spawned by the creative whims of the user.

The novelty spy kit allows the user to engage in creative and imaginative play coupled with the intrigue of espionage activities. The novelty spy kit gives the user the chance to immerse themselves into the world of the imaginative spy activities. The user of the novelty spy kit can pretend that they are actually having experiences customary of a real life spy. The novelty spy kit allows the user to engage in covert activities using the stealth typically associated with the world of espionage, thus lending itself to countless scenarios spawned by the creative whims of the user.

The novelty spy kit includes several components. There is an inconspicuous electronic safe that provides secure and portable protection for the other components of the present invention in addition to any other valuable items or documents that can be securely concealed in the confines of the safe. Safe doors and compartments are typically opened by employing the use of keys, combination locks, padlocks, depressing sequential and simultaneous buttons in a pre-programmed sequence, key punch codes, rolling dial locks and other conventional tamper-resistance methods. The methods of opening safes have been employed alone or in dual employment or in combination with several methods. But the inconspicuous electronic safe offers a unique method of unlocking to gain access to the safe. The inconspicuous electronic safe is self-contained safe that is portable, user-friendly, tamper-resistant, reliable, and durable.

The inconspicuous electronic safe is designed to be accessible only by authorized users having possession of a triggering article, such as a special ring, that initiates the completion of an integral circuit which energizes linear actuators disposed therein to slide the safe door to an open position, thereby revealing the contents stored therein.

Another object for inclusion in the present invention is a mobile fingerprint analyzer that is embodied as a conventional wristwatch with a top face portion that displays a working digital clock to surreptitiously mask its dual functionality. The top face portion of the wristwatch is pivotally attached to the base of the wrist and disengages from the base to expose the fingerprint-analyzing section of the wristwatch.

Still another object for inclusion in the present invention is a system for creating and viewing covert messages. The system teaches a pair of light-emitting eyeglasses that allows the user to read and decipher clandestine messages or codes that are scribed on special stationery using a novel writing implement having ink that is not detectable merely with the human eye. Together these embodiments are part of the novelty spy kit.

The need therefore exists in the art for a novelty spy kit game that allows for children and adults to engage in covert espionage creative and imaginative play. In the prior art, games exist, but not a novelty spy game that allows the user to engage in character role play to the novel degree of the present invention. The applicant is unaware of any such device having all the features of the present invention.

SUMMARY OF THE INVENTION

The present invention is a novelty spy kit that includes, but is not limited to, an inconspicuous electronic safe, a mobile fingerprint analyzer, and a system for creating and viewing covert messages. The present invention includes a plurality of components that form a novelty spy kit, which provides means and methods for facilitating the execution of certain tasks in a "cloak and dagger" manner that provides amusement and intrigue for children and adults alike.

The novelty spy kit allows the user to engage in creative and imaginative play and intrigue of the espionage activities. The novelty spy kit gives the user the chance to immerse themselves into the world of the imaginative spy activities. The user of the novelty spy kit can pretend that they are actually having experiences customary of a real life spy. The novelty spy kit allows the user to engage in covert activities using the stealth typically associated with the world of espionage, thus lending itself to countless scenarios spawned by the creative whims of the user.

The novelty spy kit has an inconspicuous electronic safe that provides secure and portable protection for the other components of the present invention in addition to any other valuable items or documents that can be securely concealed in the confines of the safe. Safe doors/compartments are typically opened by employing the use of keys, combination locks, padlocks, depressing sequential and simultaneous buttons in a pre-programmed sequence, key punch codes, rolling dial locks and other conventional tamper-resistance methods. The methods of opening safes have been employed alone or in dual employment or in combination with several methods. The electronic safe of the present invention is self-contained and designed to be accessible only by authorized users having possession of a triggering article, such as a special ring, that initiates the completion of an integral circuit which energizes linear actuators disposed therein to slide the safe door to an open position, thereby revealing the contents stored therein. The present invention boasts a safe that is portable, user-friendly, tamper-resistant, reliable, and durable.

The inconspicuous electronic safe is bifurcated for functionality. A first section features a central processing unit that controls the operation and access to the second section of the safe and a pivoting door panel that provides the user access to central processing unit, which controls the operation of a simulated palm scanner. In the first section, the palm scanner is recessed in the upper surface of the area exposed by the pivoting door panel and is shaped to accommodate the hand of a user. The central processing unit is a palm scanner that provides the user wearing the special ring, the ability to engage the special ring and the central processing and once these two components connect, the user has access to the second section of the inconspicuous electronic safe. When the user is wearing the ring and places his or her hand on the palm scanner, the special ring will correspond with an aperture in the palm scanner. The safe can only be opened in conjunction with a special ring donned by the user.

The second section teaches a storage area that is sealed by a sliding door panel. In the second section, the user can store any items they want to keep secure from others and or the other components of the present invention.

The first section houses adjustable light-emitting diodes ("LED") illuminate in series to simulate the effect of the palm being scanned. A magnet encased in the special ring attracts a magnet disposed in the housing of the safe and completes an electric circuit, which energizes linear actuators, located in the second section, to smoothly urge the coupled sliding door panel from a sealed position to an open position. Once the sliding door panel opens, a plurality of LEDs illuminate the interior of the storage area in the second section. Moreover, the user can record a message for playback each time the safe is accessed.

A second major component of the novelty spy kit is a mobile fingerprint analyzer that is embodied as a conventional wristwatch with a face that displays a working digital clock. The face of the wristwatch is pivotally connected to the base of the wristwatch; hence the face opens to expose a transparent support surface mounted atop a shallow compartment that defines the base. The base also features a plurality of ultraviolet ("UV") LEDs disposed in the sidewalls therein. The user places a fingerprint sample captured on transparent adhesive tape and outlined with UV powder on the transparent support surface and the UV LEDs in the base illuminate the sample against the reflective underside of the face for examination by the user. Light from UV LEDs in the sidewalls of the base can be projected onto larger areas, such as walls, tables, etc., to facilitate examination of fingerprints thereon.

A third major component of the novelty spy kit is a system for creating and viewing covert messages. The system teaches a pair of eyeglasses having battery-powered red LEDs incorporated in the arms of the eyeglasses. The red LEDs are strategically positioned to project red illumination in the general direction in which the face of the user is oriented. The selectively energizable battery pack has an integral clip for securing the battery pack to a belt. A second facet of the system features stationery having an upper surface that bears multicolor alphanumeric indicia of varying sizes randomly arranged thereon against a powder blue background. Moreover, the stationery is horizontally lined with select phrases, slogans, etc. that serve as writing guides in a manner similar to lines on conventional loose-leaf paper. Using a special green-ink writing instrument, the user can secretly transcribe a message between the line guides that can only be viewed under the illumination of the red LEDs projected from the eyeglasses. The red light represses all of the colors on the stationery except for the green ink emitted by the special writing instrument, thus revealing the covert message to wearer of the eyeglasses. To the naked eye, the stationery simply has the appearance of paper with an illegible arrangement of alphanumeric indicia.

The novelty spy kit has components that can serve as useful components in several capacities. As for the inconspicuous electronic safe can be to secure and protect valuable items from unauthorized access; yet it serves as a component to the present invention. The mobile finger print analyzer is a digital watch; yet it serves as a mobile fingerprint analyzer as part of the present invention. The special ring can serve as an ornamental jewelry piece; yet it is used in the present invention to gain access to the safe compartment of the inconspicuous electronic safe.

It is therefore the object of the present invention to provide a novelty spy kit that can entertain and accommodate the recreational or practical applications of the user. Variations and alternative embodiments logically stemming from the preferred embodiment and within the scope of the invention are also envisioned.

BRIEF DESCRIPTION OF THE DRAWINGS

Similar reference characters denote corresponding features consistently throughout the attached drawings.

3. DETAILED DESCRIPTION OF THE PREFERRED EMBODIMENTS

Figure 1:
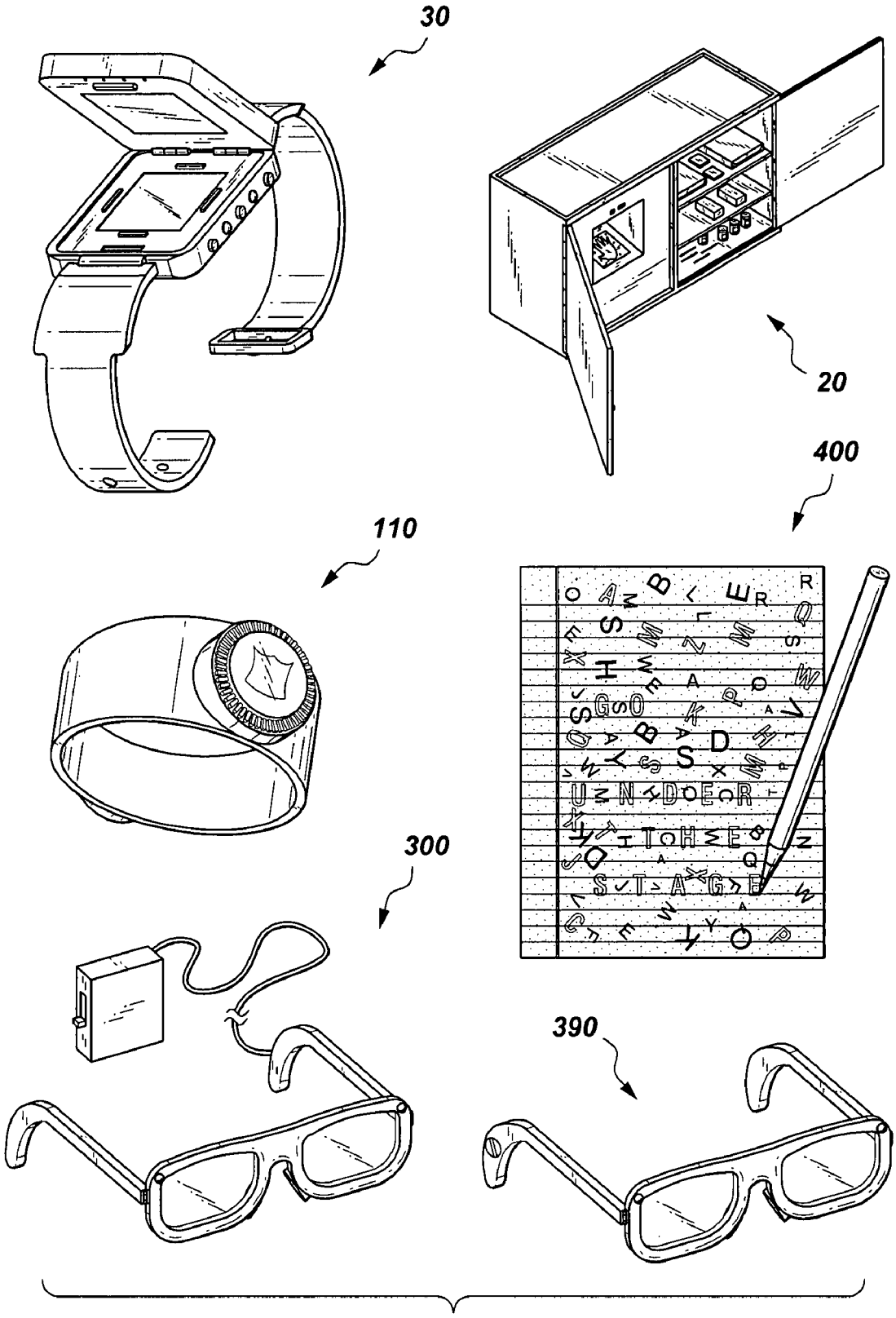
FIG. 1 is a perspective view of the components of the novelty spy kit.

The present invention is a novelty spy kit. Referring to FIG. 1, the novelty spy kit includes, but is not limited to, an inconspicuous electronic safe 20, a special ring 110, a mobile fingerprint analyzer 30, and a system for creating and viewing covert messages in the preferred embodiment with accessories. In the preferred embodiment, the system for creating and viewing covert messages includes a pair of eyeglasses 300 or 390, which are used in conjunction with treated stationery 400 and a special writing implement 430. Alternative embodiments of the invention teach the inclusion of devices, such as a utility belt, that purport a conventional functionality while concealing a dual purpose or stealth implement.

Electronic Spy Safe

Figure 2:
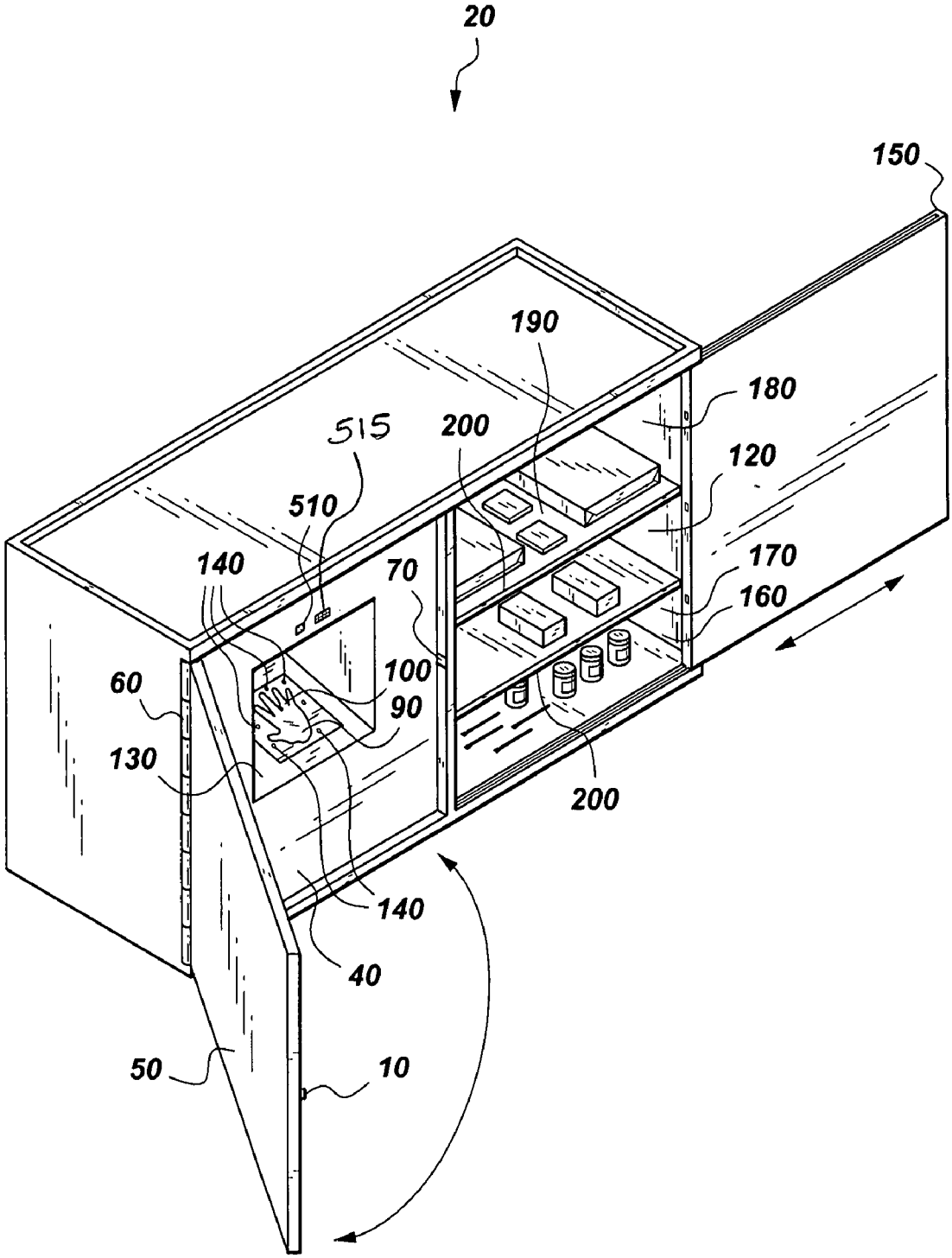
FIG. 2 is a perspective view of the electronic spy safe in an open state.

Referring to FIG. 2, the safe 20 is bifurcated into two sections. A first section 40 features a control panel door 50 that is pivotally attached to the body of the safe 20 using a single or dual hinge system 60. The control panel door 50 has snap or snug engagement mechanism closure system 70 that releasably connects with the body of the safe 20, such as corresponding magnets, to keep the door in a closed position, thus preventing inadvertent or unintentional opening. A user must apply some, but not exorbitant, force to disengage the control panel door 50 and snap or snug engagement mechanism closure system 70, which can be done with one hand by a child or adult. Alternatively, the control panel door 50 can be slidingly engaged or detachable from the safe body and remain within the scope of the invention.

Figure 3:
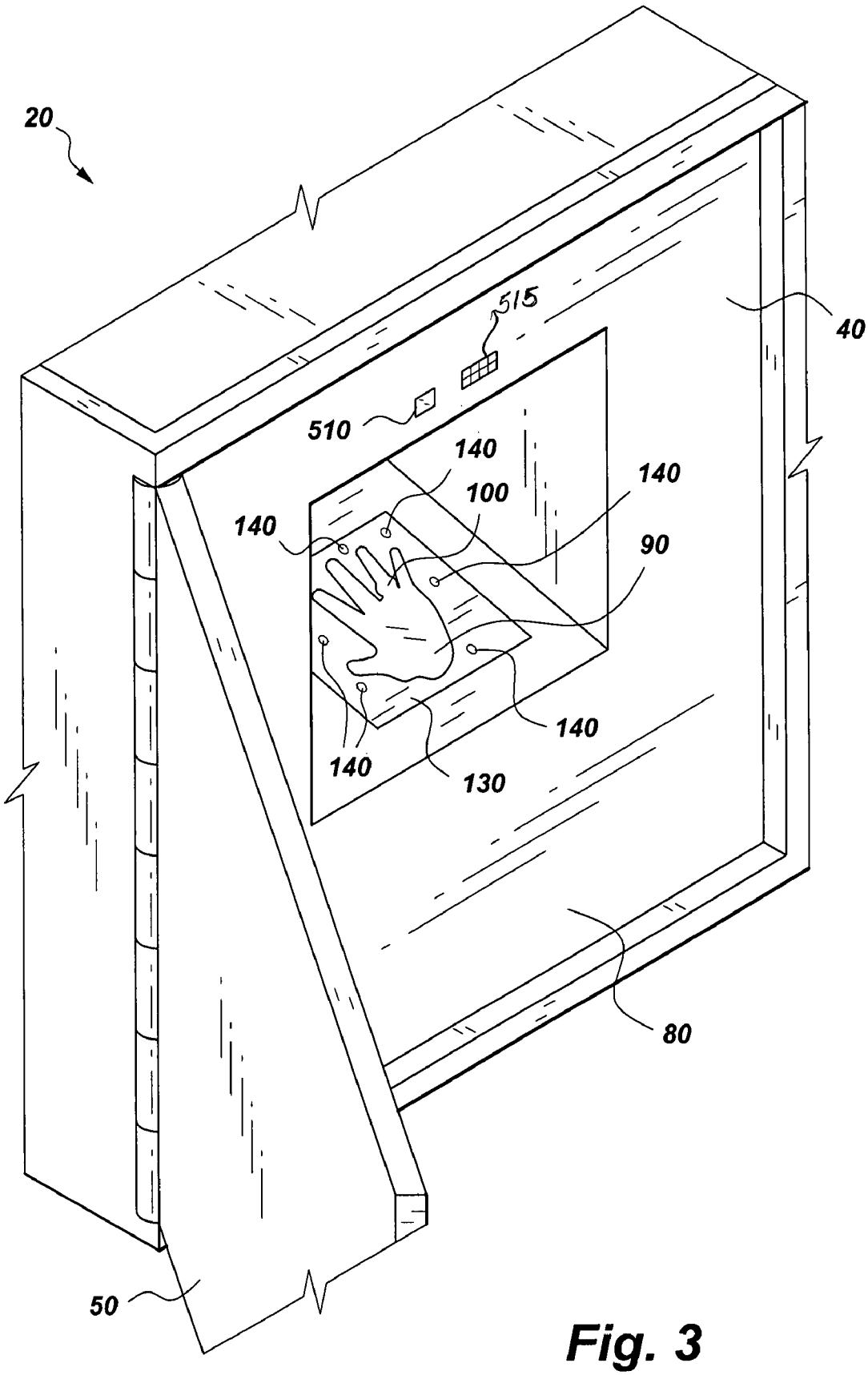
FIG. 3 is an exploded cutoff view of the control panel of the electronic spy safe.

As seen in FIGS. 2-3, a voice-recording device 515 allows the user to record a greeting or message that is played each time the control panel door 50 is opened. The voice-recording device 515 is disposed on the control panel 80 and includes a speaker to facilitate broadcasting the recorded message when the control panel door 50 is opened or at other designated times.

Referring to FIG. 3, once the control panel door 50 is selectively oriented to an open position, the user is greeted with a message and presented with a control panel 80 defined by a recessed impression 90 having the general configuration of a human hand—a palm portion with a plurality of digit portions projecting therefrom. The recessed hand impression 90 is the engageable portion of the safe 20 and simulates a conventional biometric palm scanner. The recessed hand impression 90 has a circular aperture disposed 100 in the ring finger portion that corresponds with a special ring 110, worn on the hand of an authorized user, when the authorized user engages the simulated palm scanner.

Figure 4:
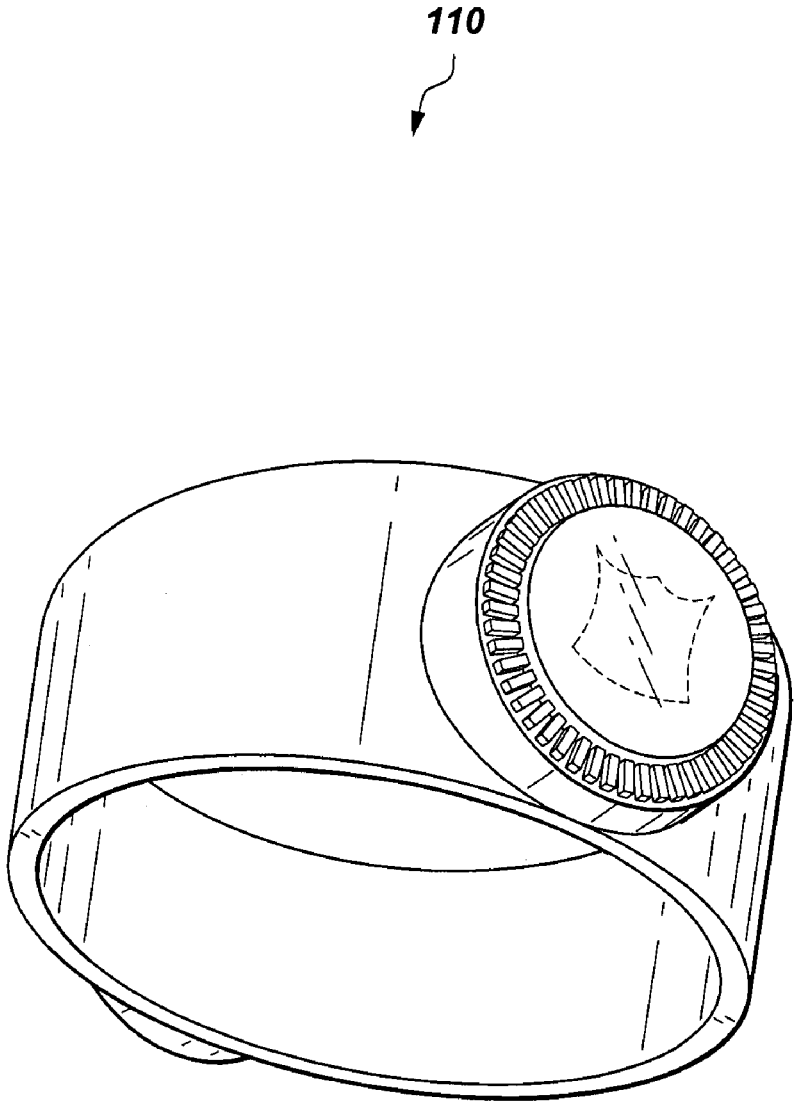
FIG. 4 is a perspective view of the special ring.

Referring to FIG. 4, the special ring 110 acts as "key" to initiate the sequence of events that culminate with the opening of the enclosed storage section 120 of the safe 20. The special ring 110 is an annular construction having a crown portion that can assume the appearance of a toy ring, a class ring, a wedding ring, or other ornate construction that serves to mask the stealth purpose of the ring 110. The base of the ring features a protruding section containing a magnet therein. In the preferred embodiment, only the base of the special ring 110 is constructed from or contains a magnet. Alternative embodiments teach that the ring can be constructed entirely from magnetic materials. The special ring 110, as shown in FIG. 4, can be adapted to several embodiments or themes according the tastes of users.

Referring back to FIG. 2, the control panel face 130 that supports the recessed hand impression 90 is constructed from a transparent or translucent rigid material, such as PLEXIGLAS™ [Poly(methyl) methacrylatel], that permits the passage of light from a plurality of LEDs 140 arranged underneath the control panel face 130. In order to cause the sliding door 150 of the safe 20 to open, the user must possess the special ring 110 having the magnetic properties. Once a user donning the special ring 110 places his or her hand in the recessed hand impression 90 and the base of the special ring 110 is nestled in the corresponding circular aperture 100 disposed in the housing of the safe 20, the magnetic portion of the special ring 110 completes an electric circuit controlled by the central processing unit ("CPU") of the control panel 80. A battery (not shown) is housed in the control panel 80 section. The battery energizes a plurality of LEDs 140 disposed beneath the recessed hand impression 90 portion in a programmable linear and sequential fashion to simulate the hand being "scanned" like a conventional palm scanner. The illumination of the plurality of LEDs 140 is programmable to adjust for the tastes of different users. For instance, the LEDs 140 can be programmed to "scan" the hand slower or faster or in a steady stream or blinking stream. The color of the LEDs 140 is uniform in the preferred embodiment, but alternatively the LEDs 140 can assume a myriad of colors.

Once the scanning simulation is complete, there is a timed delay before the dual linear actuators 160 disposed in the wall channels 170 in the storage section 120 of the safe 20 smoothly urge the sliding door 150 to an open position, thereby revealing the interior of the storage section 120. In conjunction with the opening of the slide door 150, a light system (not shown) is energized to illuminate the interior walls 180 and compartmentalized section 190 of the storage section 120 of the safe 20. The storage section 120 of safe 20 facilitates storage of any valuables, spy kit accessories, or any articles the user wants to conceal. A system of shelving 200 is attached along the walls of the storage section 120 to facilitate the organized storing of articles stored therein. The shelving 200 is adjustable and removable to accommodate the space constraints of articles stored therein.

Once the sliding door 150 is extended to an opened position, the user closes the sliding door 150 by depressing a closing switch 510 on the control panel 80. Once the closing switch 510 is depressed, the linear actuators 160 cause the sliding door 150 to travel in the reverse direction until the safe 20 is once again sealed. The contents of the storage section 120 are no longer visible or accessible.

Mobile Fingerprint Analyzer

Figure 5:
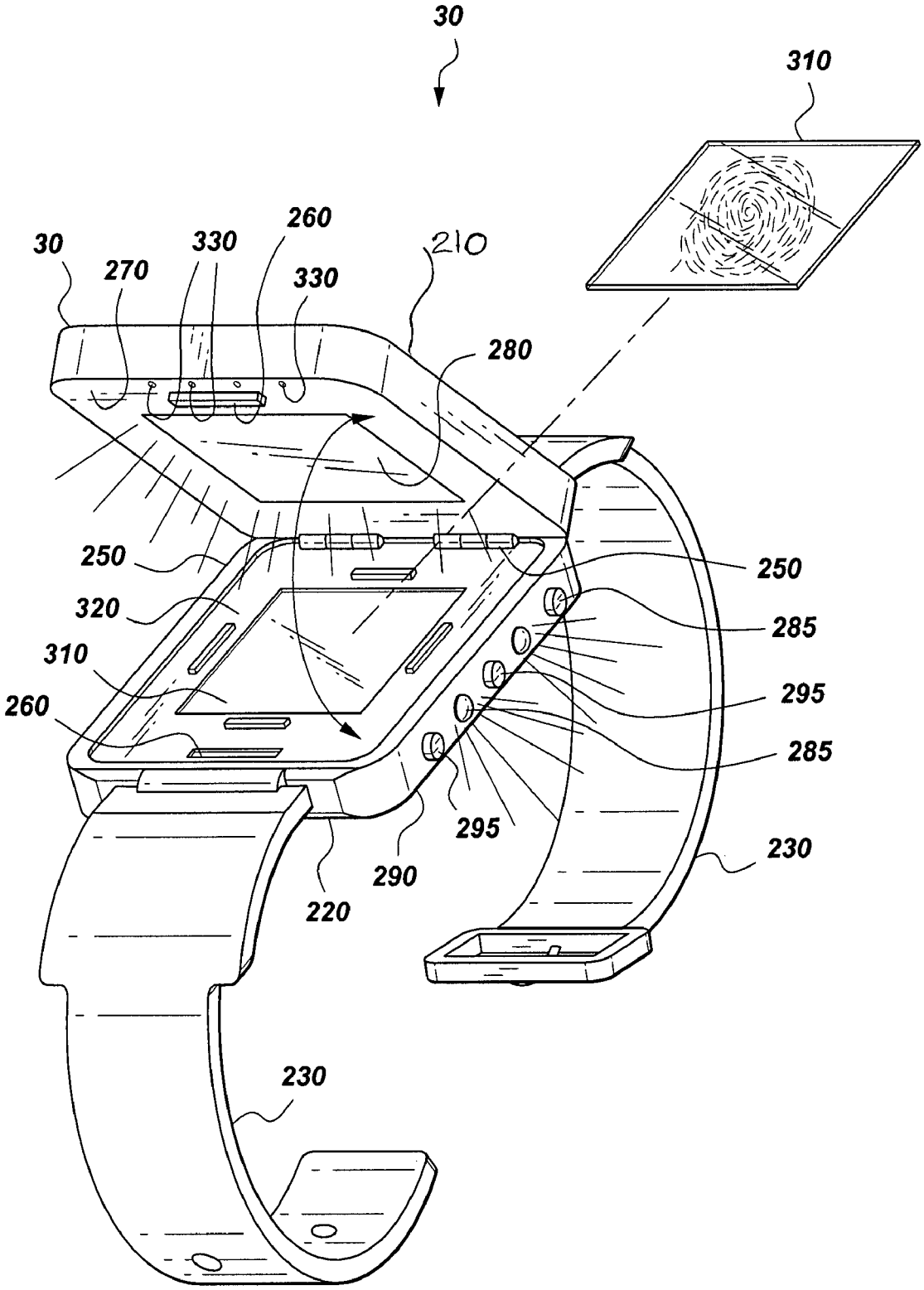
FIG. 5 is a perspective view of the mobile fingerprint analyzer in an open state with a breakaway view of the fingerprint support surface.

Referring to FIG. 5, a second component of the novelty spy kit is a portable system for analyzing a fingerprint. The mobile fingerprint analyzer 30 is embodied as a horological instrument, such as a conventional battery-powered wristwatch, which displays a working digital clock 210 with the usual assortment of digital features. Alternatively, the face of the watch can display an analog arrangement to suit the tastes of individual users.

The system for analyzing a fingerprint includes a roll of conventional transparent adhesive tape and a vial or container of ultraviolet ("UV") powder. The purpose of the adhesive tape and vial of UV powder is to facilitate the transfer and analysis of captured finger print samples by the user. Like the other articles in FIG. 2, both the adhesive tape and vial of UV powder are kept in the storage section 120 of the safe 20 for ease of access by the user.

The base portion 220 of the wristwatch 30 is supported on opposing ends by a watchband 230 coupled thereto using any number of conventional coupling means that securely support the wristwatch 30 when the watchband 230 is circumferentially engaged to the wrist of the user.

The wristwatch 30 generally has a clamshell configuration having a face portion 270 that is pivotally connected to a base portion 220 of the wristwatch using a single or dual hinge system 250 on one side. The face portion 270 and base portion 220 are releasably secured on the opposing side by a locking mechanism 260. The locking mechanism 260 is a conventional lock-and-latch assembly having a spring-actuated latch where the distal portion of the latch is defined by a hook that engages a permanent lock bar in a corresponding aperture in the base portion 220 to prevent the inadvertent or unintentional opening of the face portion 270. The locking mechanism 260 is disengaged by depressing a release cleverly disguised as one of the function buttons 295 on the side wall of the base portion 220, thus allowing the face portion 270 to pivot upwards. The locking mechanism 260 is reengaged by applying force to the face portion 270 and urging the face portion 270 downward to the base portion 220 where the interfacing components of the locking mechanism 260 automatically couple in a secure arrangement. Alternatively, a magnetic fastening system can also be employed to engage the two portions. A user must apply some, but not exorbitant, force to disengage the face portion 270 from the base portion 220 of the wristwatch, which can be done with one hand by a child or adult. Alternatively, embodiments having a face portion that can be slidingly engaged or detachable from the base are within the scope of the invention.

The underside of the face portion 270 has a reflective veneer 280 that is designed to intensify the illumination emanating from a plurality of ultraviolet ("UV") LEDs 330 disposed serially on the underside of the face portion 270 in closest proximity to the locking mechanism 260 to facilitate the projection of UV light. Another plurality of UV LEDs 285 is serially disposed in the exterior sidewall of the base portion 220 to facilitate the projection of light away from the mobile fingerprint analyzer 30 onto larger areas, such as walls, tables, etc. The UV LEDs 285, 330 are powered by the wristwatch battery 290 that is integrally housed in the base portion 220 of the wristwatch 30. The wristwatch battery 290 selectively energizes and deenergizes the UV LEDs 285, 330 on the exterior sidewall at the behest of an ON/OFF switch cleverly masked as one of the function buttons 295 located on the exterior sidewall of the wristwatch 30 near the battery housing 290.

Once the face portion 270 is selectively oriented to an open position, the user exposes a transparent support surface 310 mounted atop a shallow compartment 320 that defines the cavity of the base portion 220. The transparent support surface 310 is a glass or transparent plastic planar piece or sheet that can be removed to permit access to the shallow compartment 320 of the base portion 220. In the preferred embodiment, the UV LEDs 330 on the underside of the face portion 270 automatically illuminate when the face portion 270 is opened to expose the shallow compartment 320 of the base portion 220 and are angularly mounted to project UV light directly and prominently on the support surface 310. Alternatively, the UV LEDs 330 can be selectively energized and deenergized at the behest of an ON/OFF switch cleverly masked as one of the function buttons 295 located on the exterior sidewall of the wristwatch 30 near the battery housing 290.

A user can place on the support surface 310 a fingerprint sample captured using the conventional transparent adhesive tape and outlined with UV powder, as seen in FIG. 5. The UV light from the UV LEDs 330 contacts and radiates the UV powder to facilitate immediate analysis of the captured fingerprint sample. The reflective veneer 280 on the underside wall of the face portion 270 amplifies the intensity of the UV light, thus requiring less consumption of battery power. UV light from UV LEDs 285 in the exterior sidewalls of the base portion 220 can be projected onto larger areas, such as walls, tables, etc., to facilitate examination of fingerprints thereon.

Covert Messaging System

Figure 6:
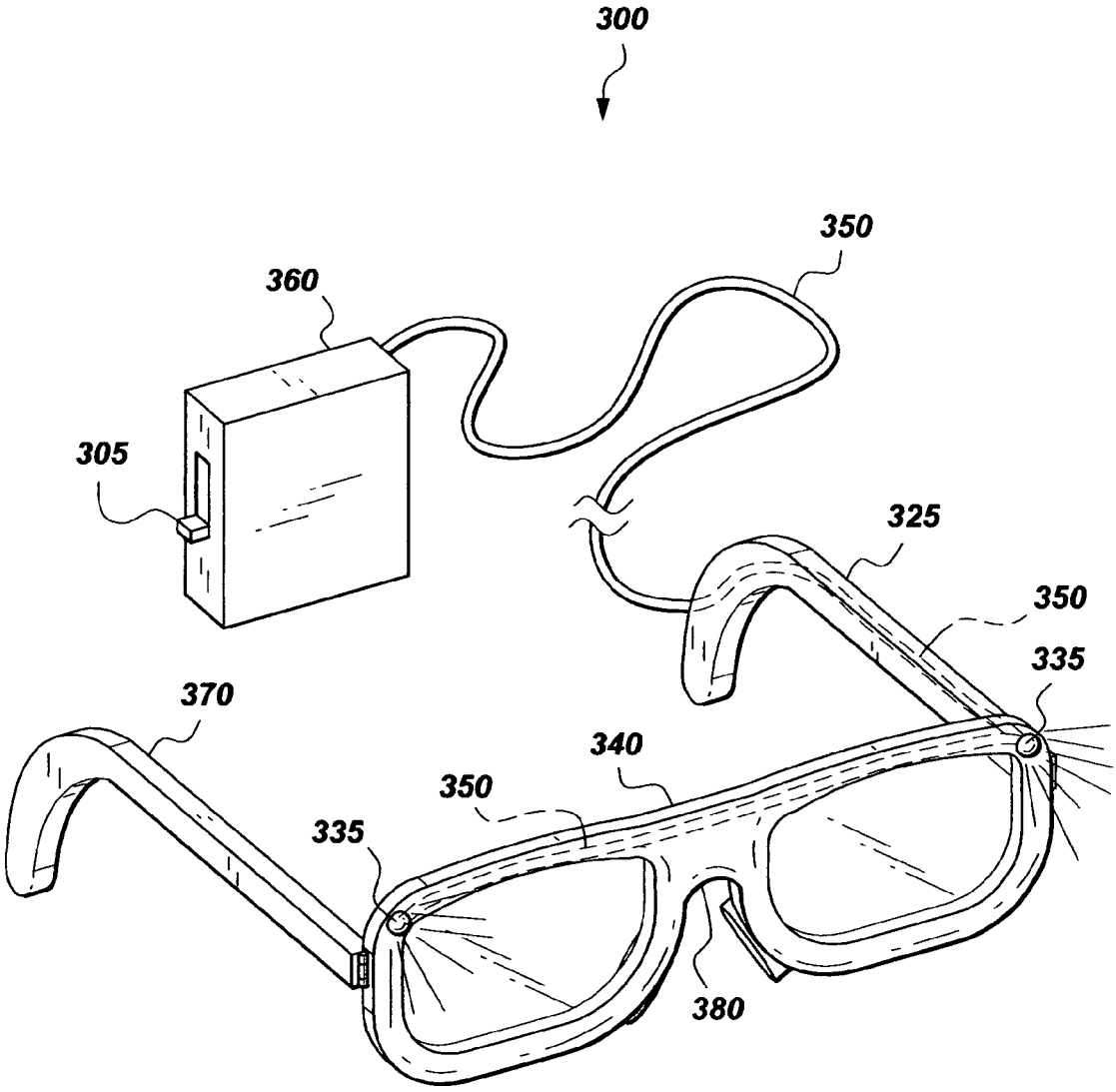
FIG. 6 is a perspective view of the novelty eyeglasses with accompanying battery pack.
Figure 7:
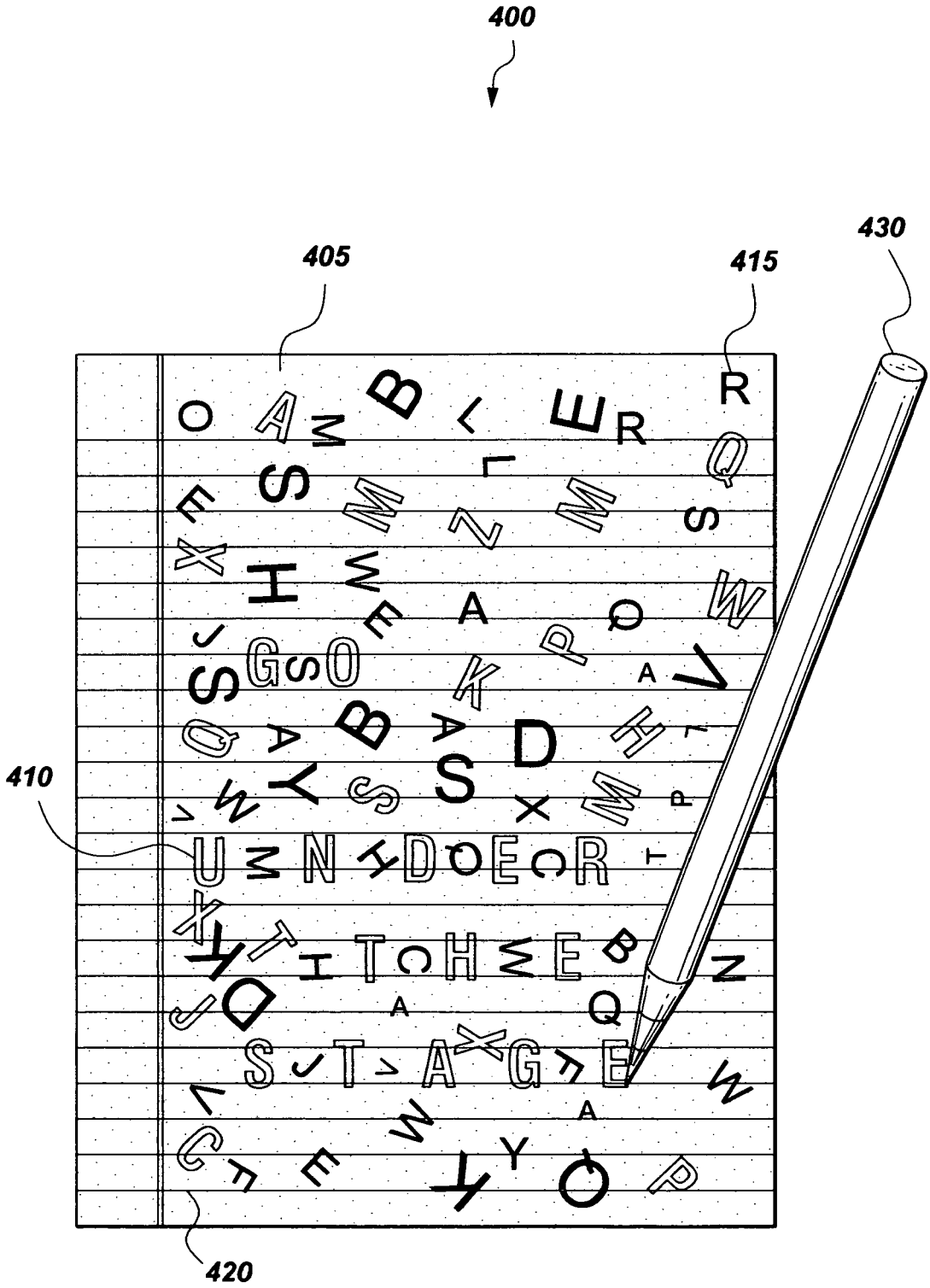
FIG. 7 is a front view of the novelty stationery with a perspective view of the special writing instrument.

A third component of the novelty spy kit is a system for creating and viewing covert messages. Referring to FIGS. 6 and 7, the system teaches a pair of special eyeglasses 300 used in conjunction with treated stationery 400 bearing garbled alphanumeric indicia 410, 415 and capable of concealing a message scribed from a special writing implement.

As seen in FIG. 6, the system features a pair of eyeglasses 300 having a conventional frame defined by two pivotally attached arm members 325 and 370 respectively coupled to a central lens frame 380 on opposing ends to support the eyeglasses 300 on the face of a user. In addition to the conventional purpose of the central lens frame 380, the central lens frame 380 houses a single battery-powered red LED 335 incorporated on each side of the front temple areas of the central lens frame 380. In the preferred embodiment, the incorporation of the LEDs 335 are not discernible when viewed from the side, as the central lens frame 380 houses the red LEDs 335 without unsightly bulging that would bring unwanted attention to the eyeglasses 300, thereby defeating the stealth purpose of the eyeglasses 300.

A first arm member 325 of the eyeglasses 300 has a channel 340 spanning the entire inner length of the first arm 325. This channel 340 serves as a conduit for wiring 350 attached to a battery pack 360 on one end and attached to the LEDs 335 in the central lens frame 380 on the opposing end. The central lens frame 380 also has a channel 340 spanning the entire inner length of the upper section and serving as a conduit for wiring 350 connected to the LEDs 335 disposed on each side of the central lens frame 380. Placement of the LEDs 335 at the proximate ends of the first arm 325 and the second arm 370 and wiring thereto is also within the scope of this invention.

The battery pack 360, shown in FIG. 6, is a compact housing capable of storing one or more batteries therein. A conventional belt clip (not shown) is mounted on the rear wall to facilitate securing the battery pack on the belt of the user or other applicable support surface. The batteries selectively energize and deenergize the LEDs 335 incorporated in the central lens frame 380 at the behest of an ON/OFF switch 305 located on the exterior of the sidewall of the battery pack 360. The wiring 350 tethered to the battery pack 360 enters through an aperture located in the distal portion of the first arm member 325 and is connected to the LED 335 disposed near the proximate end of the first arm member 325. The wiring of the LED 335 near the proximate end of the second arm member 370 is also connected therethrough.

The red LEDs 335 are strategically positioned to project red illumination in the general direction in which the face of the user is oriented when the eyeglasses 300 are donned by the user. The red LEDs 335 can be masked with decorative indicia, removable end caps, etc. to thwart detection. When the user is ready to employ the eyeglasses 300, the temporary obstructions are removed and the red LEDs 335 are energized using the battery pack.

Figure 6A:
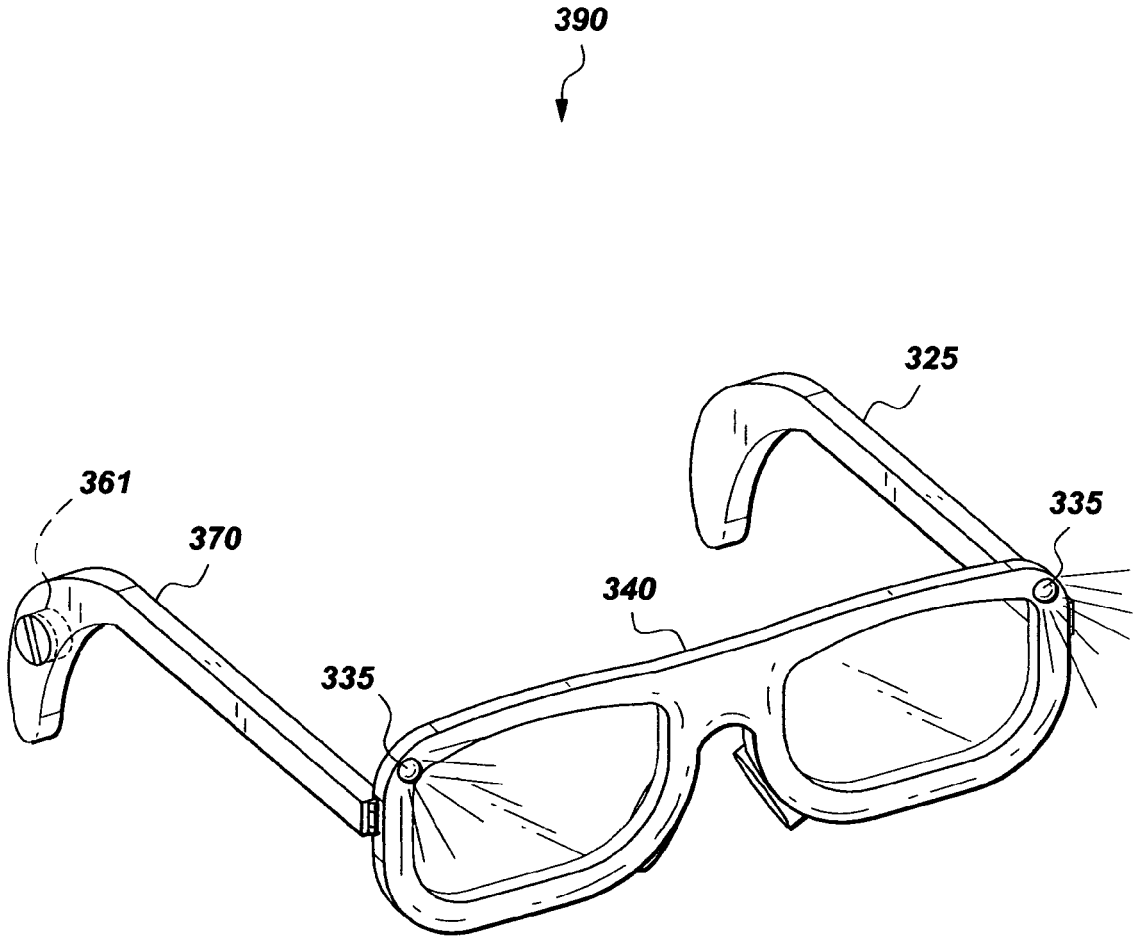
FIG. 6A depicts an alternative embodiment of the novelty eyeglasses.

Referring to FIG. 6A, a second embodiment of the eyeglasses 390 teaches the incorporation of the battery source 361 in arm 325 or arm 370 of the eyeglasses 390. The functionality of eyeglasses 390 is tantamount to that of eyeglasses 300 and the red LEDs 335 are mounted in the same manner. However, the incorporation of the battery 360 into one of the arms 325, 370 increases the stealth quality of the covert messaging system. The red LEDs 335 are selectively energized and deenergized by depressing a button (not shown) located at the distal end of either arm 325, 370 near the embedded battery 361.

Referring to FIG. 7, a second facet of the system features stationery 400 having an upper surface that bears garbled multicolor alphanumeric indicia 415 of varying sizes. In the preferred embodiment, the garbled alphanumeric indicia 415 are randomly arranged on the stationery 400 against a powder blue background 405. Alternative embodiments teach the use of different garbled indicia, such as Kanji characters, and/or backgrounds of different colors capable of producing the same desired effect.

In the preferred embodiment, the stationery 400 bears horizontal lines 420 like conventional notebook paper. In addition, select phrases, slogans, or any transferable indicia 410 can be horizontally oriented to serve as writing guides. For instance, the horizontally lined indicia 410 can reflect inspirational quotes that are serially repeated (e.g., "STAY IN SCHOOL STAY IN SCHOOL STAY IN SCHOOL" or "JUST SAY NO JUST SAY NO JUST SAY NO"). The lines could also reflect advertisements and promotional phrases (e.g., "JUST DO IT™ JUST DO IT™ JUST DO IT™" or "HAVE IT YOUR WAY™ AT BURGER KING™ HAVE IT YOUR WAY™ AT BURGER KING™"). These serial messages 410 dually serve as writing guides in a manner similar to lines on conventional loose-leaf paper. Using a special writing implement 430, the user can secretly write covert messages. The covert messages are transcribed to the stationery 400 with green ink from a special writing instrument 430. The user can secretly transcribe a message between the line guides 410, 420 that can only be viewed under the illumination of the red LEDs 335 projected from the eyeglasses 300. The red light represses all of the colors on the stationery 400 except for the green ink emitted by the special writing instrument 430, thus revealing the covert message to wearer of the eyeglasses 300. To the naked eye, the stationery 400 simply has the appearance of paper with an illegible arrangement of alphanumeric indicia 415 or repetitive phrases, slogans, etc.

Thus, it will be apparent from the forgoing description of the invention in its preferred form that it will fulfill all of the purposes attributable thereto. It should be understood that the preferred embodiments and examples described herein are for illustrative purposes only and are not to be construed as limiting the scope of the present invention, which is properly delineated only in the appended claims.

I claim:

1. A NOVELTY SPY KIT, comprising:

an electronic spy safe having a storage section and a control panel section for permitting access to said storage section;

a mobile fingerprint analyzer having a base portion defining a secret interior compartment for fingerprint analysis, and a watch face pivotally coupled to said base portion with a hinge for selectively concealing and exposing said secret interior compartment;

a pair of eyeglasses having a battery source, and an integral light source for decoding covert messages written on treated stationery using a special writing implement, said battery source for energizing said integral light source; a ring having a magnetic portion; a hinged door panel pivotally attached to said control panel section of said electronic safe; a simulated recessed palm scanner inset in said control panel section, said palm scanner having an aperture for receiving said ring; and a plurality of lights in said control panel section; wherein said palm scanner and said ring are configured such that are a circuit is closed and said lights are energized when said magnetic portion of said ring is placed in said aperture in said palm scanner.

2. The NOVELTY SPY KIT according to claim 1, wherein said mobile fingerprint analyzer has a wristwatch configuration; and said mobile fingerprint analyzer further comprises a plurality of ultraviolet LEDs and a plurality of function buttons disposed on a sidewall for energizing said ultraviolet LEDs for providing ultraviolet illumination for analyzing captured fingerprint samples.

3. The NOVELTY SPY KIT according to claim 1, wherein: said integral light source is a plurality of LEDs wired and mounted in a central lens frame of said eyeglasses, so as to provide forward light projection; and said battery source is a tethered battery pack with a belt clip.

4. The NOVELTY SPY KIT according to claim 1, further comprising a special writing implement having a special ink; and stationery having a treated surface bearing an arrangement of alphanumeric indicia so as to mask a message written in said special ink using said special writing implement.

5. The NOVELY SPY KIT according to 1, wherein said watch face comprises: an upper surface having a time display; and a lower surface facing said secret interior compartment, said lower surface comprising a plurality of LEDs and a reflective veneer.

6. The NOVELTY SPY KIT according to claim 1, further comprising a sliding door panel which is movable between an open position wherein said storage compartment is accessible and a closed position wherein said storage compartment is inaccessible, said sliding door panel being operatively coupled the circuit so as to move from the closed position to the open position when said magnetic portion of said ring is placed in said aperture of said palm scanner.

7. A NOVELTY SPY KIT, comprising:

an electronic spy safe having a storage section and a control panel section for permitting access to said storage section;

a mobile fingerprint analyzer having a base portion defining a secret interior compartment for fingerprint analysis, and a watch face pivotally coupled to said base portion with a hinge for selectively concealing and exposing said secret interior compartment;

a pair of eyeglasses having a battery source embedded in an arm, and an integral light source for decoding covert messages written on treated stationery with garbled surface indicia using a special writing implement, said battery source for energizing said integral light source; and wherein said watch face comprises: an upper surface having a time display; and a lower surface facing said secret interior compartment, said lower surface comprising a plurality of LEDs and a reflective veneer.

8. The NOVELTY SPY KIT according to claim 7, further comprising a utility belt for transporting game and novelty accessories.

9. A method of play comprising:

providing a novelty spy kit comprising: an electronic spy safe having a storage section and a control panel section for permitting access to the storage section; a mobile fingerprint analyzer having a base portion defining a secret interior compartment for fingerprint analysis, and watch face pivotally coupled to the base portion with a hinge for selectively concealing and exposing the secret interior compartment; and a pair of eyeglasses having a batter source and an integral light source for decoding covert messages writing a treated stationery using a special writing implement; providing a ring having a magnetic portion; providing a hinged door panel pivotally attached to the control panel section of the electronic safe; providing a simulated recessed palm scanner inset in the control panel section, the palm scanner having an aperture for receiving the ring; providing a plurality of lights in the control panel section, wherein the palm scanner and the ring are configured such that a circuit is closed and the lights are energized when the magnetic portion of the ring is placed in the aperture of the palm scanner; and simulating spy activities with the novelty spy kit.

10. The method of play according to claim 9, wherein said providing of the novelty spy kit comprises providing the mobile fingerprint analyzer with a wristwatch configuration having a plurality of ultraviolet LEDs and a plurality of function buttons on a sidewall thereof for energizing the ultraviolet LEDs to provide ultraviolet illumination for analyzing captured finger prints.

11. The method of claim 10, wherein said simulating spy activities with the novelty spy kit comprises:

pivoting the watch face of the mobile fingerprint analyzer on the hinge so as to expose the secret interior compartment;

placing a fingerprint sample in the secret interior compartment; and actuating one or more of the function buttons to energize the ultraviolent LEDs.

12. The method of claim 9, wherein in said providing of the novelty spy kit, the integral light source is a plurality of LEDs wired and mounted to a central lens frame of the eyeglasses for forward light projection, and the battery source is a tethered battery pack with a belt clip.

13. The method of claim 9, wherein said providing of the novelty spy kit further comprises:

providing a special writing implement having a special ink of a particular color; and providing stationery having a treated surface bearing an arrangement of alphanumeric indicia so as to mask a message written in the special ink.

14. The method of claim 13, wherein said simulating spy activities with the novelty spy kit comprises:

writing a message on the stationery in the special ink with the special writing implement., the message being masked by the treated surface of the stationery; and directing the light source of the eyeglasses toward the stationery, so as to repress all colors on the treated surface except the color of the special ink such that message is visible.

15. The method of claim 9, wherein said simulating spy activities with the novelty spy kit comprises placing the magnetic portion of the ring in the aperture of the palm scanner, so as to close the circuit and energize the lights in the control panel section of the electronic spy safe.

* * * * *